US009671182B2

(12) United States Patent
Takagi et al.

(10) Patent No.: US 9,671,182 B2
(45) Date of Patent: Jun. 6, 2017

(54) COPPER ALLOY TUBE FOR HEAT EXCHANGER EXCELLENT IN FRACTURE STRENGTH

(75) Inventors: Toshiaki Takagi, Kobe (JP); Yasuhiro Aruga, Kobe (JP); Mamoru Nagao, Kobe (JP); Takashi Shirai, Tokyo (JP); Masato Watanabe, Tokyo (JP); Akihiko Ishibashi, Tokyo (JP)

(73) Assignees: KOBELCO & MATERIALS COPPER TUBE, LTD., Tokyo (JP); Kobe Steel, Ltd., Kobe-shi (JP)

( * ) Notice: Subject to any disclaimer, the term of this patent is extended or adjusted under 35 U.S.C. 154(b) by 1426 days.

(21) Appl. No.: 12/254,345

(22) Filed: Oct. 20, 2008

(65) Prior Publication Data

US 2009/0101323 A1 Apr. 23, 2009

(30) Foreign Application Priority Data

Oct. 23, 2007 (JP) ..... 2007-275394

(51) Int. Cl.
*C22C 9/02* (2006.01)
*F28F 21/08* (2006.01)

(52) U.S. Cl.
CPC ..... *F28F 21/08* (2013.01); *C22C 9/02* (2013.01)

(58) Field of Classification Search
None
See application file for complete search history.

(56) References Cited

FOREIGN PATENT DOCUMENTS

| | | | | |
|---|---|---|---|---|
| EP | 0 947 592 A1 | | 10/1999 | |
| JP | 63-50439 | | 3/1988 | |
| JP | 2000-199023 | | 7/2000 | |
| JP | 2003-268467 | * | 9/2003 | ..... C22C 9/02 |
| JP | 2003-301250 | | 10/2003 | |
| JP | 2004-27331 | | 1/2004 | |
| JP | 2004-292917 | | 10/2004 | |
| JP | 3794971 | | 4/2006 | |
| JP | 2006-274313 | | 10/2006 | |

OTHER PUBLICATIONS

U.S. Appl. No. 12/811,339, filed Jun. 30, 2010, Aruga.
U.S. Appl. No. 12/244,195, filed Oct. 2, 2008, Masato Watanabe, et al.
U.S. Appl. No. 12/297.069, filed Oct. 14, 2008, Aruga, et al.
U.S. Appl. No. 12/374,154, filed Jan. 16, 2009, Aruga, et al.
U.S. Appl. No. 12/441,904, filed Mar. 19, 2009, Aruga, et al.
U.S. Appl. No. 12/672,092, filed Feb. 4, 2010, Aruga, et al.
U.S. Appl. No. 13/491,942, filed Jun. 8, 2012, Aruga, et al.
U.S. Appl. No. 13/491,911, filed Jun. 8, 2012, Aruga, et al.

* cited by examiner

*Primary Examiner* — Yoshitoshi Takeuchi
(74) *Attorney, Agent, or Firm* — Oblon, McClelland, Maier & Neustadt, L.L.P.

(57) ABSTRACT

The present invention provides a copper alloy tube for heat exchangers which is tolerable to a high operating pressure of new cooling media such as carbon dioxide and HFC-based fluorocarbons, and is excellent in fracture strength, even if the tube is thinned, and a copper alloy tube for a heat exchanger which has a composition having specified amounts of Sn and P, has an average crystal grain size of 30 μm or less and has a high strength of 250 MPa or more of a tensile strength in the longitudinal direction of the tube improves the fracture strength as a texture in which the orientation distribution density in the Goss orientation is 4% or less.

3 Claims, No Drawings

COPPER ALLOY TUBE FOR HEAT EXCHANGER EXCELLENT IN FRACTURE STRENGTH

BACKGROUND OF THE INVENTION

Field of the Invention

The present invention relates, in particular, to a high strength copper alloy tube that is suitable to a heat exchanger using a cooling medium such as an HFC-based fluorocarbon or $CO_2$ and is excellent in pressure fracture strength and processability.

Description of the Related Art

For example, a heat exchanger for air conditioners is primarily constituted with a U-shaped copper tube bent like a hairpin (hereinafter, copper tubes also include a copper alloy tube) and fins (hereinafter, referred to aluminum fins) made from aluminum or an aluminum alloy plate. More specifically, for the heat transfer part of a heat exchanger, a copper tube bent in a U-shape is passed through through-holes of aluminum fins and a jig is inserted into the U-shaped copper tube to expand the tube, thereby closely attaching the copper tube and the aluminum fin each other. Then, further, the open end of this U-shaped copper tube is tube-expanded and a bent copper tube similarly bent in a U-shape is inserted into the tube-expanded open end. The bent copper tube is brazed to the tube-expanded open end with a brazing material such as copper phosphor brazing filler metals, thereby being connected to make a heat exchanger.

Thus, a copper tube used for a heat exchanger requires thermal conductivity as basic properties as well as good bending workability and good brazing properties when the above heat exchanger is produced. Phosphorous-deoxidized copper which has appropriate strength has been widely used as a copper tube material which is good in the properties.

On the other hand, HCFC (hydro-chlorofluorocarbon)-based fluorocarbons have been widely used for cooling media used for heat exchangers such as air conditioners. However, HCFC has a large ozone depleting potential, so that HFC (hydrofluorocarbon)-based fluorocarbons with small values of the ozone depleting potential have come to be used recently from the viewpoint of earth environment protection. In addition, $CO_2$ which is a natural cooling medium recently has come to be used for heat exchangers used for water heaters, automotive air-conditioning equipment, vending machines, and the like.

However, the condensing pressure during operation needs to be enlarged to use these HFC-based fluorocarbons and $CO_2$ as new cooling media and maintain the same heat transfer performance as HCFC-based fluorocarbons. Usually, in a heat exchanger, pressures at which these cooling media are used (pressure of a fluid which flows in the heat exchanger tube of a heat exchanger) become maximum in a condenser (gas cooler in $CO_2$). In this condenser or a gas cooler, for instance, R22 of HCFC-based fluorocarbons has a condensing pressure of about 1.8 MPa. On the other hand, in order to maintain the same heat transfer performance as R22, R410A of HFC-based fluorocarbons needs to have a condensing pressure of 3 MPa and the $CO_2$ cooling medium needs to have a condensing pressure of about 7 to 10 MPa (supercritical state). Therefore, the operating pressures of these new cooling media increase by a factor of 1.6 to 6 as compared with the operating pressure of the conventional cooling medium R22.

However, heat exchanger tubes made from phosphorous-deoxidized copper have a small tensile strength, whereby the thickness of the heat exchanger tube needs to be large in order to strengthen the heat exchanger tube, corresponding to an increase in operating pressure of these new cooling media. Additionally, upon assembly of heat exchangers, the brazed part is heated to a temperature of 800° C. or more for a several seconds to tens of second, so that crystal particles are made bulky in the brazed part and its vicinity as compared with other parts, leading to a decrease in strength due to softening. As the results, when a heat exchanger tube made from phosphorous-deoxidized copper is used for a heat exchanger for a new cooling medium, the thickness needs to be larger than before. Accordingly, the use of phosphorous-deoxidized copper as a heat exchanger tube for a new cooling medium such as an HFC-based fluorocarbon or $CO_2$ increases the mass of the heat exchanger by an amount of thickening of the heat exchanger tube, thereby raising the price.

For this reason, a heat exchanger tube which has a high tensile strength, excellent processability and good thermal conductivity is strongly demanded for thinning of the heat exchanger tube. In this respect, there is a definite relation between the tensile strength of a heat exchanger tube and its thickness. For example, when the operating pressure of a cooling medium which flows in a heat exchanger tube is set to be P, the outer diameter of the heat exchanger tube is set to be D, the tensile strength of the heat exchanger tube (in the longitudinal direction of the heat exchanger tube) is set to be $\sigma$ and the thickness of the heat exchanger tube (bottom thickness in the case of the inner helically grooved tube) set to be t, the relation $P=2\times\sigma\times t/(D-0.8\times t)$ is present between them. When this equation is arranged as for t, $t=(D\times P)/(2\times\sigma+0.8\times P)$, showing that the larger the tensile strength of the heat exchanger tube, the smaller the thickness. When the heat exchanger tube is actually selected, a heat exchanger tube of the tensile strength and the thickness calculated by further multiplying the operating pressure P of the above cooling medium with the safety ratio S (normally, from about 2.5 to 4) is used.

A variety of copper alloy tubes such as Co—P-based and Sn—P-based copper alloy tubes which have strength higher than that of phosphorous-deoxidized copper have conventionally been proposed instead of phosphorous-deoxidized copper to satisfy the demand of the thinning of such a heat exchanger tube. For example, as the Co—P-based copper alloy tube, a seamless copper alloy tube for a heat exchanger which contains Co: 0.02 to 0.2%, P: 0.01 to 0.05% and C: 1 to 20 ppm, restricts a impurity of oxygen, has an excellent loading endurance of 0.2% and has an excellent fatigue strength has been proposed (see Japanese Patent Laid-Open No. 2000-199023).

In addition, as the Sn—P-based copper alloy tube, a copper alloy tube for a heat exchanger which contains Sn: 0.1 to 1.0% and P: 0.005 to 0.1%, restricts impurities such as O and H, is made from a composition to which Zn is selectively added and further has an average crystal grain size of 30 μm or less has been proposed (see Japanese Patent No. 3794971 and Japanese Patent Laid-Open Nos. 2004-292917 and 2006-274313).

On the other hand, as a technology to improve the fracture strength of heat exchanger tubes, a copper alloy tube for a heat exchanger to which alloy elements such as Al and Si are added has been proposed (see Japanese Patent Laid-Open Nos. 63-50439 and 2003-301250). Additionally, in a phosphor bronze copper alloy plate which has a large amount of Sn and is not an Sn—P-based copper alloy tube, it is well-known to specify a texture specified by X-ray diffraction intensity for improving the fracture strength of the plate (see Japanese Patent Laid-Open No. 2004-27331).

SUMMARY OF THE INVENTION

Incidentally, a large tensile force is exerted upon the heat exchanger tube of a heat exchanger by the operating pressure P of a cooling medium in the circumferential direction of the tube (also referred to hoop direction) rather than in the longitudinal direction of the heat exchanger tube. For this reason, in the breakdown of the heat exchanger tube, the tensile strength exerted on the circumferential direction of this heat exchanger tube causes cracks in the heat exchanger tube, leading to breakdown in many cases. Therefore, in order to improve the fracture strength for the heat exchanger tube of a copper alloy tube such as an Sn—P-based copper alloy tube particularly, the restraint of crack generation in the heat exchanger tube is important against the tensile strength exerted upon the circumferential direction of this copper alloy tube (heat exchanger tube).

On the other hand, in the prior art for improving the fracture strength of the copper alloy tube, cracks cannot be restrained which are generated by the tensile strength applied to the circumferential direction of the copper alloy tube such as a particularly thinned Sn—P-based copper alloy tube, so that the fracture strength for the heat exchanger tube cannot sufficiently be improved. Accordingly, even in the strengthened copper alloy tubes such as the Sn—P-based copper alloy tube, in order to obtain a sufficient fracture strength corresponding to an increase in the operating pressure of a cooling medium using a new cooling medium, a reasonable tube thickness is needed, and therefore further thinning is difficult.

The present invention was made in consideration of such problems. An object of the invention is to provide a copper alloy tube for a heat exchanger which restrains crack generation in a heat exchanger tube against the tensile force exerted on the circumferential direction of the heat exchanger tube and is excellent in fracture strength.

For the above object, the gist of a copper alloy tube for a heat exchanger excellent in fracture strength of the present invention is a copper alloy tube which contains Sn: 0.1 to 3.0% by mass and P: 0.005 to 0.1% by mass, in which the remainder has a composition made from Cu and inevitable impurities, in which the average crystal grain size is 30 μm or less, and in which the longitudinal tensile strength of the tube is 250 MPa or more; this copper alloy tube has a texture whose orientation distribution density in the Goss orientation is 4% or less.

Here, the proportion of the low-angle grain boundaries of the inclination angle 5 to 15° in a texture of the above copper alloy tube is preferably 1% or more. In addition, the above copper alloy tube preferably contains Zn: 0.01 to 1.0% by mass. Additionally, the above copper alloy tube preferably totally contains 0.07% by mass or less of one or two or more kinds of elements selected from the group consisting of Fe, Ni, Mn, Mg, Cr, Ti and Ag.

The present invention, as a premise of making the fracture strength of an Sn—P-based copper alloy tube excellent, makes the average crystal grain size refining and the longitudinal tensile strength of the tube high strength in a certain level or more. Based on this, the texture of the Sn—P-based copper alloy tube is controlled to thereby restrain the crack generation of a heat exchanger tube against the tensile strength exerted on the circumferential direction of the heat exchanger tube, making the fracture strength excellent.

As a matter of course, in the case of the Sn—P-based copper alloy tube of the present invention, the formation of these textures is different depending on the manufacturing process, the conditions and the heat treatment method of the copper alloy tube. However, this copper alloy tube does not have a structure mainly occupied by a specific orientation crystal face, but has a structure (texture) having random orientation crystal faces such as the Cube orientation, the Goss orientation, the Brass orientation (also referred to the B orientation), the Copper orientation (also referred to the Cu orientation) and the S orientation.

The present inventors have investigated the effect of each of the above orientations, i.e., each of the above orientations which is not so large in terms of the value of the orientation distribution density, on the fracture strength in a texture of an Sn—P-based copper alloy tube which is such a "random texture." As a result, of each of the above orientations in these textures, the inventors have found that only the Goss orientation greatly affects the fracture strength and each of the other orientations does not greatly affect the fracture strength as compared with the effect of the Goss orientation although the extents are different each other.

The amount (orientation distribution density) of crystal faces (crystal particles) in the Goss orientation which is inevitably present in the texture of an Sn—P-based copper alloy tube is not so much due to a "random texture." However, the Goss orientation in a texture of the Sn—P-based copper alloy tube has an adverse effect on the fracture strength of the copper alloy tube even if the amount is small. In other words, when the orientation distribution density in the Goss orientation in a "random texture" of the Sn—P-based copper alloy tube becomes a certain degree or more, this density promotes the crack generation of the heat exchanger tube to the tensile force exerted on the circumferential direction of the heat exchanger tube, remarkably lowering the fracture strength of the copper alloy tube.

On the other hand, in order to improve the fracture strength of a heat exchanger tube, an elongation is needed which deforms while decreasing the thickness of the tube in the circumferential direction of the tube against the tensile strength exerted on the circumferential direction of the heat exchanger tube. As described above, in the breakdown of a heat exchanger tube in which a large tensile strength is exerted upon the circumferential direction of the heat exchanger tube rather than the longitudinal direction of the heat exchanger tube, the tensile strength exerted on the circumferential direction of this heat exchanger tube causes cracks in the heat exchanger tube, leading to breakdown in many cases. Elongation deformation capability (characteristic) to the circumferential direction of the tube is needed which can be deformed while decreasing the thickness of the tube in the circumferential direction of the tube in order to restrain the crack generation of the heat exchanger tube against the tensile force exerted on the circumferential direction of this heat exchanger tube.

Here, according to one other finding of the present inventors, although the elongation deformation capability to the circumferential direction of such a heat exchanger tube is still uncertain in its detailed mechanism, it is estimated to be governed by a mutual balance between the tensile strength $\sigma T$ and the elongation $\delta$ in the circumferential direction of the tube as a mechanical property in the circumferential direction of the heat exchanger tube. That is, in order to restrain cracks which are generated by the tensile strength exerted on the above circumferential direction, simple enlargement of the tensile strength $\sigma L$ in the tube longitudinal direction of the heat exchanger tube or the tensile strength σT in the circumferential direction may not solve the situation. The reason why the above prior art cannot sufficiently improve the fracture strength as the heat exchanger tube of particularly thinned copper alloy tube such as an Sn—P-based tube is estimated that this finding is not considered.

From the characteristics of crystal particles in each orientation in the texture, the r-value (value of the plastic strain ratio) of the crystal particles having the Goss orientation in the circumferential direction of the tube which is a direction perpendicular to the longitudinal direction of the tube (extrusion direction of the tube) is theoretically infinite. Thus, in the crystal particles which have the Goss orientation, the thickness of the tube cannot be decreased in the circumferential direction of the tube. In other words, when many crystal particles having the Goss orientation are present in the texture of a copper alloy tube, the mutual balance between the tensile strength σT and the elongation δ is broken, thus decreasing the elongation deformation in the circumferential direction of the tube. As a result, it is estimated that the heat exchanger tube is hard to deform in the circumferential direction of the tube against the tensile strength exerted on the circumferential direction of the heat exchanger tube, thereby generating cracks in the heat exchanger tube, highly possibly leading to a breakdown.

On the other hand, according to the present invention, by making small amount of the crystal particles having the Goss orientation of the texture of a copper alloy tube, it is possible to improve the mutual balance of the tensile strength σT and the elongation δ in the circumferential direction of the tube, thereby being capable of improving the elongation deformation capability in the circumferential direction of the tube. As a result, the heat exchanger tube is deformable in the circumferential direction of the tube even by the tensile strength exerted on the circumferential direction of the tube and the cracks are hardly generated in the heat exchanger tube (time generating cracks is delayed), thereby being capable of increasing the fracture strength of the heat exchanger tube (copper alloy tube).

DETAILED DESCRIPTION OF THE PREFERRED EMBODIMENTS

Hereinafter, first, the texture (orientation distribution density and crystal grain size) and the characteristics (strength) of the Sn—P-based copper alloy tube of the present invention will be described.

(Texture)

The Sn—P (—Zn)-based copper alloy tube of the present invention, as described above, does not normally and commonly have many specific orientation crystal faces, but has a structure (texture) in which crystal faces of main orientations such as the Cube orientation, the Goss orientation, the Brass orientation (also referred to the B orientation), the Copper orientation (also referred to the Cu orientation) and the S orientation are each present at random.

The copper alloy tube of the present invention is produced by extrusion and the copper alloy tube obtained by extrusion is also expressed by the extrusion face and the extrusion direction of the extrusion element tube (the rolling face and the rolling direction when the extrusion element tube is rolled and processed) in the same manner as in the texture of a plate material by rolling. The extrusion face is expressed by {ABC}, and the extrusion direction is expressed by <DEF>. Based on such expressions, each of the above orientations is expressed in the following.

| | |
|---|---|
| Cube orientation | {0 0 1} <1 0 0> |
| Goss orientation | {0 1 1} <1 0 0> |
| Rotated-Goss orientation | {0 1 1} <0 1 1> |
| Brass orientation (B orientation) | {0 1 1} <2 1 1> |
| Copper orientation (Cu orientation) | {1 1 2} <1 1 1> |
| (or D orientation | {4 4 11} <11 11 8>) |
| S orientation | {1 2 3} <6 3 4> |
| B/G orientation | {0 1 1} <5 1 1> |
| B/S orientation | {1 6 8} <2 1 1> |
| P orientation | {0 1 1} <1 1 1> |

(Orientation Distribution Density in Goss Orientation)

The present invention makes the average crystal grain size refining and at the same time as premise of making the tensile strength in the longitudinal direction of the tube high strength in a certain level or more, characteristically makes the orientation distribution density in the Goss direction in the texture of the Sn—P-based copper alloy tube 4% or less, thereby making the fracture strength excellent.

Here, the elimination of the Goss orientation in a "random texture" of the Sn—P-based copper alloy tube (the orientation distribution density is made 0%) is difficult in manufacturing. Therefore, in the present invention, from the viewpoint of fracture strength improvement, the allowable value of the orientation distribution density in the Goss orientation in a "random texture" of an Sn—P-based copper alloy tube is made 4% or less, whereby reducing the orientation distribution density in the Goss orientation as small as possible.

When the orientation distribution density of the Goss orientation which has an adverse effect of the fracture strength of a copper alloy tube and remarkably decreases the fracture strength of the copper alloy tube is made as small as 4% or less as described above, the mutual balance of the tensile strength σT and the elongation δ is improved, thus being capable of improving the elongation deformation capability in the circumferential direction of the tube. As a result, the heat exchanger tube is deformable in the circumferential direction of the tube even by the tensile strength exerted on the circumferential direction of the tube and the cracks are hardly generated in the heat exchanger tube (time generating cracks is delayed), thereby being capable of increasing the fracture strength of the heat exchanger tube (copper alloy tube).

On the other hand, if the orientation distribution density in the Goss orientation exceeds 4%, the crystal particles which have the Goss orientation in the texture of a copper alloy tube becomes excessive. Therefore, the mutual balance of the tensile strength σT and the elongation δ collapses, thereby lowering the elongation deformation capability in the circumferential direction of the tube. As a result, the heat exchanger tube in the circumferential direction becomes difficult to be deformed in the circumferential direction of the tube against the tensile strength exerted on the circumferential direction of the heat exchanger tube, thereby generating cracks in the heat exchanger tube and highly possibly leading to a breakdown, being incapable of increasing the fracture strength of the heat exchanger tube (copper alloy tube).

In addition, the regulation of making the orientation distribution density in the Goss orientation in the present invention 4% or less is a regulation in a texture in which the texture of an Sn—P-based copper alloy tube is randomly present in each of the orientations as described above. In this respect, it may be almost impossible that the orientation distribution density in the Goss orientation also, if it is within the manufacturing range of a usual Sn—P-based copper alloy tube, exceeds about ten and a few percent. However it has not been known so far that the orientation distribution density in such a Goss orientation has a critical boundary as to whether the fracture strength of a heat exchanger tube (copper alloy tube) is superior or inferior. This is estimated because the texture of an Sn—P-based copper alloy tube itself is hardly known and further the texture of the Sn—P-based copper alloy tube is a "random texture" and the orientation distribution density in the Goss orientation is not so large, and thus has hardly been noted so far.

As described above, if each of the above orientations other than the Goss orientation which constitute a "random texture" are within the manufacturing range of a usual Sn—P-based copper alloy tube, usual orientation distribution densities may be each 10% or less, for example, may not possibly exceed about 10 and a few percent. Additionally, if each of the above orientations other than the Goss orientation is within this range, although each extent may be different, it does not have a large effect on the fracture strength of the heat exchanger tube (copper alloy tube) as compared with the Goss orientation.

(Measurement of Orientation Distribution Density)

The orientation distribution density in the Goss orientation of an Sn—P-based copper alloy tube is measured on its face parallel to the longitudinal direction of the copper alloy tube (axial direction) by the crystal orientation analysis method (SEM/EBSP method) using the Electron Backscatter Diffraction Pattern (EBSP) under the Scanning Electron Microscope (SEM).

The crystal orientation analysis method which uses the above EBSP irradiates the surface of a sample set in the lens tube of an SEM with an electron beam and then projects an EBSP onto a screen. This is photographed with a highly sensitive camera and taken into a computer as an image. The computer analyzes this image and compares the image with a pattern by simulation which uses an already-known crystal system to determine the orientation of the crystal.

This method is also well known in crystal orientation analysis of a diamond thin film, a copper alloy, and the like, as a high resolution crystal orientation analysis method. In addition, the details of these crystal orientation analysis methods are described in Vol. 52, No. 2 pp. 66-70 (September, 2002) in the Kobe Steel Technical Report, Japanese Patent Laid-Open No. 2007-177274, etc. Additionally, examples of carrying out the crystal orientation analysis of copper alloys by this method are disclosed in Japanese Patent Laid-Open Nos. 2005-29857 and 2005-139501, etc.

The crystal orientation analysis method which uses the above EBSP does not measure every crystal particle, but scans and measures a specified sample region at arbitrary regular intervals. In addition, the above process is automatically executed at all the measurement points, so that tens of thousand to several-hundred thousand crystal orientation data are obtained at the completion of measurement. Therefore, the observation field of view is wide and there is an advantage that the average crystal grain size, the standard deviation of the average crystal grain size or information on orientation analysis, against many crystal particles, is obtained within several hours. Moreover, there is also an advantage that each of the information on many measurement points which cover the entire measurement region can be obtained.

On the other hand, X-ray diffraction (X-ray diffraction intensity, etc.) used widely for the measurement of textures measures the structure (texture) of a relatively microscopic region per crystal particle as compared with the crystal orientation analysis method which uses the above EBSP. Thus, a structure (texture) of a relatively macroscopic region which affects the fracture strength of a heat exchanger tube (copper alloy tube) cannot be precisely measured as compared with the crystal orientation analysis method which uses the above EBSP.

The crystal orientation analysis procedure by this method will be more specifically described. First, a test piece for structure observation is collected from a face parallel to the longitudinal direction (axial direction) of a manufactured copper alloy tube and is subjected to mechanical polishing and buffing and then to electric polishing to thereby adjust the surface. For the test piece obtained in this manner, each crystal particle is determined whether or not it is a targeted orientation (10° or less from an ideal orientation) and then its orientation density is obtained in a measurement field of view using, for example, an SEM available from JOEL Ltd. and the EBSP measurement and analysis system OIM (Orientation Imaging Macrograph) and an analytical software of its system (software name "OIM Analysis") available from TSL.

In this case, the measurement region of a material to be measured is usually divided into regions such as hexagons and then a Kikuchi pattern is obtained from each of the divided regions using reflection electrons of an electron ray injected to the sample surface. In this case, an electron beam is scanned on the sample surface in a two dimension and the crystal orientation is measured per specified pitch to thereby be able to measure the orientation distribution of the sample surface. Next, the resulting Kikuchi pattern is analyzed to find the crystal orientation of the electron ray injection position. That is, the resulting Kikuchi pattern is compared with data of already-known crystal structures, and the crystal orientation at its measurement point is evaluated. In the same way, the crystal orientation of a measurement point adjacent to its measurement point is evaluated and if the orientation difference of their mutually adjacent crystals is within ±10° (shift within ±10° from the crystal face), the crystal orientation is taken (assumed) to belong to the same crystal face. Moreover, when the orientation difference of both crystals exceeds ±10°, its space is taken as the grain boundary (side or the like with which both of the hexagons are contacted). Thus, the distribution of the grain boundary of the sample surface is evaluated. The range of the measurement field of view is set to a region of, for example, about 500 μm×500 μm, and this ranges of a test piece are measured at several appropriate sites and averaged.

In addition, these orientation distributions are varied in the thickness direction, so that several points in the thickness direction are preferably taken, averaged and evaluated. However, because the copper alloy tube is a thin of a thickness of 1.0 mm or less, the value measured for a thickness as it is can be evaluated.

(Proportion of Low-Angle Grain Boundaries)

In the present invention, in order to further improve the fracture strength in addition to the control of the orientation distribution density in the above Goss orientation, preferably the proportion of a low-angle grain boundaries is further specified. In other words, the proportion of the low-angle grain boundaries of the inclination angle 5 to 15° in a texture of the Sn—P-based copper alloy tube is set to be 1% or more.

In the Sn—P-based copper alloy tube to be targeted, not only the orientation distribution density of the above Goss orientation and the average crystal grain size to be described below but also the proportion of the low-angle grain boundaries greatly affects the fracture strength. In the texture of the Sn—P-based copper alloy tube, originally the proportion of the low-angle grain boundaries is small in absolute terms. However, even if the proportion is small, when the proportion of the low-angle grain boundaries becomes large, the "concentration of strains" when cracks are generated by the tensile strength exerted on the circumferential direction of the heat exchanger tube can be avoided. Hence, the deformation in the circumferential direction of the tube is easily formed in the same manner as in the orientation distribution density control in the above Goss orientation. As a result, the cracks are hardly generated in the heat exchanger tube (time generating cracks is delayed), thereby being capable of increasing the fracture strength of the heat exchanger tube (copper alloy tube).

Therefore, in order to surely improve the fracture strength of the Sn—P-based copper alloy tube, the proportion of the low-angle grain boundaries based on all grain boundaries is preferably made 1% or higher. When the proportion of this low-angle grain boundaries is as small as less than 1%, there is a possibility that the case where the fracture strength cannot be improved is generated even if the orientation distribution density in the above Goss orientation is controlled.

This low-angle grain boundary is a crystal boundary in which the crystal orientation difference is as small as 5 to 15° among the grain boundaries measured by the crystal orientation analysis method in which the above SEM is equipped with the EBSP system. The grain boundary in which the crystal orientation difference is larger than 15° becomes a high-angle grain boundary. In the present invention, the proportion of these low-angle grain boundaries is set to be 1% or more as the proportion of the total length of the grain boundaries of these low-angle grain boundaries measured by the above crystal orientation analysis method (length of the sum of the grain boundaries of the total low-angle grain boundaries measured) to the total length of the grain boundaries in which the crystal orientation difference is from 5 to 180° (length of the sum of the grain boundaries of the total crystal particles measured).

In other words, the proportion of the low-angle grain boundaries is calculated as ((total length of the grain boundaries of 5 to 15°)/(total length of the grain boundaries of 5 to 180°))×100. About 30% is a manufacturable limit though the upper limit of the proportion of the low-angle grain boundaries is not particularly specified.

(Average Crystal Grain Size)

In the copper alloy tube of the present invention, the average crystal grain size is set to be 30 μm or smaller. When the thickness of a heat exchanger tube is particularly thinned to 200 μm or less due to demands of lightweighting and thinning, the influence of the crystal grain size becomes remarkable although the influence is small when the thickness is relatively large. In other words, when the average crystal grain size is large, the "concentration of strains" when cracks are generated by the tensile force exerted on the circumferential direction of a heat exchanger tube cannot be avoided, whereby cracks are likely to be generated in the heat exchanger tube. As a result, it is difficult to improve the fracture strength even though the textures such as the orientation distribution density in the above Goss orientation and the proportion of the low-angle grain boundaries are controlled.

Moreover, a copper alloy tube is subjected to bending process when incorporated in a heat exchanger such as an air conditioner, a bend section is liable to have a fracture. Furthermore, when a copper alloy tube is processed to a heat exchanger, a crystal grain size is affected by heat due to brazing, whereby the crystal grain size is coarsened. Unless the average crystal grain size is refined to 30 μm or smaller in advance, the average crystal grain size highly possibly exceeds 100 μm due to its coarsening, largely decreasing the compression strength in a brazing part. For this reason, reliability will be lowered when a copper alloy tube is used for a heat exchanger for a HFC-based fluorocarbon cooling medium with a high operating pressure and for a carbon dioxide cooling medium. Therefore, the average crystal grain size in the copper alloy tube of the present invention is made refined to 30 μm or less, and the crystal particles are not coarsened in the stage of a copper alloy tube.

For this average crystal grain size, the average crystal grain size in the thickness direction of the copper alloy tube is measured for the face parallel to the longitudinal direction of the copper alloy tube by the cutting method according to JIS H 0501. The results measured at arbitrary 10 sites in the longitudinal direction of the copper alloy tube are averaged to take the resultant value as the average crystal grain size (μm).

(Tensile Strength)

In a copper alloy tube of the present invention, the tensile strength σL in the longitudinal direction of the tube (direction of the tube axis) is made as high a strength as 250 MPa. When the thickness of a copper alloy tube has a thickness of 1.0 mm or less, and is made thinned to about 0.8 mm, strengthening which is 250 MPa or higher is needed, in order to obtain the fracture strength (compression strength) at the time of use of the above new cooling medium as a premise. In addition, when the strength of the copper alloy tube is low, the strength which decreases after brazing when the tube is incorporated into a heat exchanger such as an air conditioner is sufficiently unwarrantable.

However, even if the copper alloy tube is highly strengthened, unless textures such as the orientation distribution density in the above Goss orientation are controlled, the mutual balance of the tensile strength σT and the elongation δ in the circumferential direction of the tube is rather worsened. For this reason, the fracture strength as the heat exchanger tube of a copper alloy tube such as an Sn—P-based tube cannot be improved in some cases.

Additionally, in the copper alloy tube of the present invention, a heat exchanger tube with a small diameter is targeted, and therefore a test piece for the tensile strength test cannot be collected from the circumferential direction in some cases. For this reason, the tensile strength σT in the circumferential direction of the tube cannot possibly be measured directly in some cases, whereby the strength is specified by a measurable tensile strength σL in the longitudinal direction of the tube.

(Measurement)

The texture, the average crystal grain size and the strength of these copper alloy tubes are effective depending on servinge as a heat exchanger. Therefore, even a copper alloy tube to be shipped as a final product for a heat exchanger or even a product prior to assembly as a heat exchanger or even a product after assembly as a heat exchanger (including a product during use or after use, as a heat exchanger) is specified in a state of a part other than a part which is brazed. Accordingly, whether or not a product is within the range of the present invention is determined by measuring the texture, the average crystal grain size and the strength of the copper alloy tube in this state.

(Copper Alloy Component Composition)

Next, the copper alloy component composition of the heat exchanger tube for the heat exchanger of the present invention will be described below. In the present invention, the component composition of a copper alloy satisfies the requirement characteristics as a copper tube for a heat exchanger and is an Sn—P-based copper alloy with high productivity. The requirement characteristics of the copper tube for the heat exchanger need to satisfy a high thermal conductivity, bending workability and brazing property when a heat exchanger is produced, and the like. The productivity needs to be able to execute shaft kiln ingot casting and hot extrusion.

For this reason, the component composition of the present invention contains Sn: 0.1 to 3.0% by mass and P: 0.005 to 0.1% by mass, and its remainder includes Cu and inevitable impurities. In addition to this, selectively, the composition may further contain Zn: 0.01 to 1.0% by mass or may totally contain 0.07% by mass of one or two or more kinds of elements selected from the group consisting of Fe, Ni, Mn, Mg, Cr, Ti and Ag. Hereinafter, the reasons of containing and limiting the component of each element of these copper alloy component compositions will be described.

Sn: 0.1 to 3.0% by Mass

Sn has effects of improving the tensile strength of a copper alloy tube and restraining the coarsening of crystal particles, and allows to be thin in its tube thickness compared with a phosphorous-deoxidized copper. When the Sn content of a copper alloy tube exceeds 3.0% by mass, segregation in the ingot becomes large, so that the segregation might not be eliminated completely by usual hot extrusion and/or thermo-mechanical treatment, whereby the metal structure, the mechanical property, the bending workability, and the structure and mechanical properties after brazing of the copper alloy tube become ununiform. Additionally, the extrusion pressure is increased, so that the extrusion temperature needs to be increased in order to extrude the copper alloy at the same extrusion pressure as that of a copper alloy having an Sn content of 3.0% by mass. This increases the surface oxidation of the extrusion material, thereby decreasing productivity and increasing surface flaws of the copper alloy tube. On the other hand, if the Sn content is less than 0.1% by mass, a sufficient tensile strength and a small crystal grain size as described above cannot be obtained.

P: 0.005 to 0.1% by Mass

P, like Sn, has Effects of Improving the Tensile Strength of a copper alloy tube and restraining the coarsening of crystal particles, and allows to be thin in its tube thickness compared with a phosphorous-deoxidized copper. If the P content of a copper alloy tube exceeds 0.1% by mass, the fracture during hot extrusion is liable to be generated, thus increasing the susceptivity to stress corrosion cracking and largely decreasing the thermal conductivity.

When the P content is less than 0.005% by mass, the amount of oxygen is increased due to deacidification shortage to generate an oxide of P, decreasing the soundness of the ingot and decreasing the bending workability as a copper alloy tube. On the other hand, if the P content is less than 0.005% by mass, a sufficient tensile strength and a small crystal grain size as described above cannot be obtained.

Zn: 0.01 to 1.0% by Mass

Inclusion of Zn makes it possible to improve the strength, heat resistance and fatigue strength without greatly lowering the thermal conductivity of the copper alloy tube. Moreover, the addition of Zn enables a decrease in abrasion of a tool used for cold rolling, drawing, inner grooving and the like, has an effect of extending lives of a drawing plug, a plug with grooves, and the like, and contributes to a decrease in production cost. If the content of Zn exceeds 1.0% by mass, the tensile strengths in the longitudinal and circumferential directions of the tube are rather decreased, leading to lowering of the fracture strength. Moreover, the susceptivity to stress corrosion cracking will be high. Furthermore, when the content of Zn is less than 0.01% by mass, the above effects are not sufficiently achieved. Therefore, the content of Zn when selectively contained needs to be from 0.01 to 1.0% by mass.

Total Content Less than 0.07% by Mass of One or Two or More Kinds of Elements Selected from the Group Consisting of Fe, Ni, Mn, Mg, Cr, Ti and Ag:

Fe, Ni, Mn, Mg, Cr, Ti, Zr, and Ag all enhance the strength, the pressure fracture strength, and the heat resistance of the copper alloy of the present invention and improve bending workability by refining crystal particles. However, when the content of one or two or more kinds of elements selected from the above elements exceeds 0.07% by mass, the extrusion pressure is increased, and therefore the hot extrusion temperature needs to be increased when the extrusion is executed by the same extrusion force as the one in the case where these elements are not added. As a result, the surface oxidation of the extrusion material increases, and thus surface flaws are frequently generated in the copper alloy tube of the present invention, thereby being incapable of improving the fracture strength particularly as a heat exchanger tube of a copper alloy tube such as a thinned Sn—P-based tube. For this reason, in the case of a selective inclusion, one or two or more kinds of elements selected from the group consisting of Fe, Ni, Mn, Mg, Cr, Ti and Ag are desirably made to be contained totally less than 0.07% by mass. The above content is desirably less than 0.05% by mass, more desirably less than 0.03% by mass.

Impurities:

The other elements are impurities. These contents are preferably as small as possible in order to improve fracture strength particularly as a heat exchanger tube of a copper alloy tube such as an Sn—P-based tube. However, due to the cost of reducing the amounts of impurities, realistic allowable values of typical impurity elements (amounts of the upper limit) are shown below.

S:

S of a copper alloy tube binds with Cu to form a compound and is present in the matrix. If blending proportion of low-grade copper metals, scraps, and the like as starting materials is increased, the content of S is increased. S promotes ingot fracture and hot extrusion fracture during ingoting. In addition, when an extrusion material is cold-rolled or drawing-processed, a Cu—S compound extends in the axial direction of the tube, being liable to generate fractures at the interface of the copper alloy matrix and the Cu—S compound. Therefore, surface defects, fractures, or the like is likely generated in a semifinished product under processing and a product after processing and particularly the fracture strength as a heat exchanger tube of a thinned Sn—P-based copper alloy tube is lowered. Additionally, when the bending processing of the tube is executed, it becomes a starting point of crack generation, whereby the frequency of crack generation becomes high in the bend section. As a result, the S content is made to be 0.005% by mass or less, desirably 0.003% by mass or less, more desirably 0.0015% by mass or less. For the reduction of the S content, countermeasures are effective which decrease the amounts of a Cu ground metal of a low grade and scraps used, reduce SOx gases in a melting atmosphere, select a proper refractory lining, add to a molten metal in a small amount elements having a strong affinity with S, such as Mg and Ca, and the like.

As, Bi, Sb, Pb, Se, and Te, Etc.:

Impurity elements such as As, Bi, Sb, Pb, Se and Te other than S similarly decrease the soundness of an ingot, a hot extrusion material and a cold process material, and lower the fracture strength particularly as a heat exchanger tube of a copper alloy tube such as a thinned Sn—P-based tube. Thus, the total content (total amount) of these elements is preferably 0.0015% by mass or less, desirably 0.010% by mass or less, more desirably 0.0005% by mass.

O:

If the content of O exceeds 0.005% by mass in a copper alloy tube, an oxide of Cu or Sn is involved in the ingot, thus decreasing the soundness of the ingot and the fracture strength particularly as a heat exchanger tube of a copper alloy tube such as a thinned Sn—P-based tube. Hence, the content of O is preferably 0.005% by mass or less. For further improvement of bending workability, the content of O is desirably 0.003% by mass or less, more desirably 0.0015% by mass or less.

H:

When hydrogen (H) taken into a molten metal at the time of melting cast increases, hydrogen in which the amount of its solid solution is decreased during solidification deposits in the grain boundary of an ingot, thereby forming many pin holes and generating cracks during hot extrusion. Moreover, when a copper alloy tube which is processed by rolling and drawing is annealed after extrusion, H is condensed during annealing in the grain boundary. This is liable to generate swells and lower the fracture strength particularly as a heat exchanger tube of a copper alloy tube such as a thinned Sn—P-based tube. Hence, the content of H is preferably 0.0002% by mass or less. For further improvement of fracture strength including the product yield, the content of H is desirably 0.0001% by mass or less. In addition, for the reduction of the content of H, countermeasures such as drying of a starting material during melting cast, scorch of charcoal covering for molten metal, lowering of the dew point of atmosphere contacted with the molten metal and slight oxidation of the molten metal prior to phosphorus addition are effective.

(Method of Manufacturing Copper Alloy Tube)

Next, a method of manufacturing a copper alloy tube of the present invention will be described below by way of an example of a case of a smooth tube. The copper alloy tube of the present invention is manufacturable by a process according to a common method. However, special conditions necessary to make the texture of a copper alloy tube within the requirements of the present invention are present.

First, electrolyte copper of a starting material is molten in a state of charcoal coating. After melting of the copper, predetermined amounts of Sn and Zn are added thereto and further P is added as a P intermediate alloy (15% by mass Cu) serving for deoxidation. At this time, a mother alloy of Cu—Sn—P can be used in place of mother alloys of Sn and Cu—P. After completion of component adjustment, a billet of a given size is fabricated by a semi-continuous casting. The resulting billet is heated in a heating furnace and subjected to homogenization. In addition, before hot extrusion, the billet is desirably maintained at from 750 to 950° C. for about one minute to two hours and homogenized for segregation improvement.

Thereafter, the billet is subjected to perforation processing by piercing and hot extruded at from 750 to 950° C. The production of the copper alloy tube of the present invention requires as a premise of the segregation elimination of Sn and the achievement of refining of a structure in the production tube. For that purpose, the reduction rate of sectional area by hot extrusion ((doughnut-shaped area of perforated billet−sectional area of the element tube after hot extrusion)/(doughnut-shaped area of perforated billet)×100%) is made 88% or more, desirably 93% or more. In addition, the element tube after the hot extrusion is cooled by a method such as water cooling such that the cooling rate until the surface temperature becomes 300° C. is 10° C./sec or higher, desirably 15° C./sec or higher, more desirably 20° C./sec or higher.

(Extrusion Element Tube Structure)

Here, if the deformation texture remains in the extrusion element tube after the hot extrusion, it is difficult to make the orientation distribution density in the Goss orientation in a texture of an Sn—P-based copper alloy tube which is a product as small as 4% or less and make the fracture strength excellent. This is because crystal particles of the deformation texture action as a seed of the Goss orientation in an annealing step such as the final annealing and tends to be crystal particles in the Goss orientation. Accordingly, an extrusion element tube after hot extrusion needs to be a recrystallization structure with deformation textures as few as possible.

On the other hand, the Sn—P-based copper alloy tube has high strength compared with the heat exchanger tube made from phosphorous-deoxidized copper, and thus needs a high extrusion force compared with the heat exchanger tube made from phosphorous-deoxidized copper, though depending on the ability of a hot extruder, so that the extrusion rate tends to become slow. In other words, when the Sn—P-based copper alloy tube is extruded, a common method requires time, and thus the temperature is decreased. Thus, the copper alloy tube is liable to be a Duplex grain structure in which the deformation texture remains in a extrusion element tube which should be a recrystallization structure. As a result, it is difficult to make the orientation distribution density in the Goss orientation in the texture of an Sn—P-based copper alloy tube of a product as small as 4% or less and make the fracture strength excellent.

(Time Required from Heating Furnace Take-Out to Hot Extrusion Completion)

Thus, in order to make an extrusion element tube after hot extrusion a recrystallization structure with deformation textures as few as possible, although it depends on the heating temperature or the ability of hot extruder, in the range of a presently widely used in direct extruder or indirect extruder for a copper tube, the time required from heating furnace takeoff to hot extrusion completion (after cooling by water cooling or the like) is made as short as possible. The operation needs to be carried out within 5.0 minutes, more preferably within 3.0 minutes.

Next, the extrusion element tube is processed by rolling to thereby reduce the outer diameter and the thickness. The processing rate at this time is made to be 92% or less in terms of the reduction rate of sectional area to thereby be able to decrease defective products during rolling. Moreover, an element tube of a given size is manufactured by subjecting the rolled element tube to drawing processing. Usually, the drawing processing is executed by using a plurality of drawing benches. The processing rate (reduction rate of sectional area) by each drawing bench is made to be 35% or less to thereby be able to decrease surface flaws and internal fractures in the element tube.

(Final Annealing Processing)

Thereafter, in the cases of carrying out bending processing in a customer, producing an inner helically grooved tube using a drawing tube, and the like, the drawing tube is subjected to the final annealing to make an O material by tamper designation. For continuous annealing of the copper alloy tube of the present invention, a roller hearth furnace usually used in annealing of a copper tube coil or the like or heating with a high-frequency induction coil which passes a copper tube through the above coil while energizing the high-frequency induction coil can be utilized. When the copper alloy tube of the present invention is manufactured by the roller hearth reactor, the substansive temperature of the drawing tube becomes 400 to 700° C., and the drawing tube is desirably annealed so as to be heated at the temperature for one minute to 120 minutes. In addition, the drawing tube is desirably heated such that the average rate of temperature rise from room temperature to a predetermined temperature is 5° C./min or more, desirably 10° C./min or more.

If the substansive temperature of the drawing tube is lower than 400° C., it does not become a complete recrystallized structure (fibrous deformation texture remains), so that the bending processing and the processing of the inner helically grooved tube in a customer become difficult. Additionally, at a temperature of exceeding 700° C., the crystal particles are enlarged, the bending processing of the tube rather decreases, and the tensile strength of the tube decreases in the inner helically grooved tube, whereby an elongation in the longitudinal direction of the tube becomes large and it is difficult to form the fin of the inside tube surface in a proper shape. Hence, the drawing tube is desirably annealed at the substansive temperature in a range of from 400 to 700° C. Moreover, when the heating time within this temperature range is shorter than one minute, the drawing tube does not have a complete recrystallized structure, causing the above-described problems. Furthermore, even if annealing is carried out for more than 120 min, the crystal grain size does not change and thus annealing effect will be saturated, whereby the heating time is suitably from one minute to 120 minutes in the above temperature range.

In addition, annealing of a high-speed temperature rise, a rapid quench, and a short time heating may be performed using a high frequency induction heating furnace in place of continuous annealing by the above roller hearth furnace.

(Product Tube Structure after Final Annealing)

Here, when the cooling rate after the final annealing is slow, the Goss orientation is prone to develop in a cooling process, so that it is difficult to make the orientation distribution density in the Goss orientation in the texture of the Sn—P-based copper alloy tube which is a product as small as 4% or less. Additionally, it is also difficult to make the proportion of the low-angle grain boundaries of the above inclination angle 5-15° 1% or more; as a result, it is difficult to make the fracture strength excellent. Moreover, when the cooling rate is slow, the crystal particles are also prone to be coarsened in the cooling process.

(Cooling Rate after Final Annealing and Rate of Temperature Rise at Final Annealing)

Therefore, the cooling rate after the final annealing is made fast as much as possible, at 1.0° C./minute or more, preferably at 5.0° C./minute or more, more preferably at 20° C./minute or more. Moreover, in order not to make the crystal particles coarsened, the average rate of temperature rise from room temperature to a predetermined temperature is desirably faster. When the rate of temperature rise is slower than 5° C./minute, the crystal particles are liable to be enlarged even if they are heated to the same temperature. Thus, it is not desirably from the viewpoints of pressure fracture strength and bending workability and at the same time it inhibits productivity. As a result, the average rate of temperature rise from room temperature to a predetermined temperature is desirably 5° C./minute or more.

The above is a manufacturing method of the smooth tube. The smooth tube annealed in this manner is subjected to drawing processing with a variety of processing rates as required and may be made a processing tube in which the tensile strength is made improved. Moreover, for the inner helically grooved tube, the annealed smooth tube is subjected to inner grooving process with a grooving. Thus, after the inner helically grooved tube is manufactured, usually the tube is further annealed. In addition, the inner helically grooved tube annealed in this manner is subjected to drawing processing with a light processing rate if necessary and the tensile strength may be made improved.

EXAMPLES

Hereinafter, Examples of the present invention will be described. An Sn—P-based copper alloy tube (smooth tube) in which the component composition such as an element for alloy and the texture are each changed was manufactured by changing manufacturing conditions. Structures such as average crystal grain sizes, orientation distribution densities in Goss orientations and proportions of low-angle grain boundaries of the inclination angle 5 to 15° and mechanical properties of these copper alloy tubes were investigated and at the same time their fracture strengths were measured and evaluated. These results are shown in Tables 1 and 2.

(Manufacturing Conditions of Smooth Tube)

(a) Electrolyte copper was a starting material and predetermined Sn was added to the molten metal and further Zn was added thereto as required and then a Cu—P mother alloy was added thereto to thereby fabricate a molten metal of a predetermined composition. The element compositions of these melted copper alloys are shown in Table 1 as component compositions of copper alloy tubes.

(b) An ingot of diameter 300 mm×length 6500 mm was semi-continuously cast at a cast temperature of 1200° C. and the resulting ingot was cut into billets of a length of 450 mm.

(c) The billet was heated to 650° C. by a billet heater and then heated to 950° C. by a heating furnace (induction heater). In two minutes after the temperature reached 950° C., the billet was taken out. The billet was primarily subjected to piercing processing of a diameter of 80 mm by a hot extruder, and immediately (without delay) was processed by the same hot extruder to fabricate an extrusion element tube of an outer diameter of 96 mm and a thickness of 9.5 mm (reduction rate of sectional area: 96.6%). The average cooling rate of the extrusion element tube after the hot extrusion to 300° C. was set to be at 40° C./min.

(d) In this case, in Invention Examples, in order to make an extrusion element tube after hot extrusion to be a recrystallized structure with deformation textures as few as possible, the time required from the heating furnace takeout to the hot extrusion completion (after cooling by water cooling or the like) was commonly a short time of 5.0 minutes or less. The times required from this heating furnace take-out to the hot extrusion completion are shown Table 2.

(e) The extrusion element tube was subjected to rolling to fabricate a rolled element tube of an outer diameter of 35 mm and a thickness of 2.3 mm. The pulling-out drawing processing was repeated such that the reduction rate of sectional area of the rolled element tube was 35% or less in a drawing step of one time to obtain a copper alloy tube-O material with an outer diameter 9.52 mm and a thickness of 0.80 mm.

(f) The above drawing tube was heated to 450 to 630° C. in a reducing gas atmosphere as final annealing in the annealing furnace (average rate of temperature rise 12° C./minute), and was maintained at this temperature for 30 to 120 minutes and then passed through a cooling zone and cooled to room temperature to make a sample material.

(g) In this case, in Invention Examples, the cooling rates after these final annealing were as fast as possible, at a cooling rate of 1° C./min. The cooling rates after these final annealing are shown in Table 2.

Structures such as the average crystal grain sizes, the orientation distribution densities in the Goss orientation and proportions of the low-angle grain boundaries of the inclination angle 5 to 15°, the mechanical properties, and the characteristics such as the fracture strengths of these manufactured copper alloy tubes (outer diameter of 9.52 mm, thickness of 0.80 mm, O material) are shown in Table 2. In addition, in Table 1 above, Invention Examples and Comparative Examples all commonly had an S content of 0.005% by mass or less, a total content (total amount) of 0.0005% by mass of As, Bi, Sb, Pb, Se and Te, an O content of 0.003% by mass, an H content of 0.0001% by mass, in the copper alloy tube.

(Tensile Test)

For the tensile strengths in the longitudinal and circumferential directions of the tube, the copper alloy tube manufactured above was rifted, cut open and flattened and then test pieces were cut out from the longitudinal and circumferential directions to fabricate tensile test pieces of a length of 29 mm and a width of 10 mm. The test piece was measured for the tensile strength σL of the longitudinal direction of the tube, the tensile strength σT of the circumferential direction, and the elongation by a precision universal testing machine, 5566 Model, available from Instron Corp. Additionally, although the tensile test piece was obtained by cutting the tube open and being flattened and subjected to tensile strength measurement, sectional parts of materials produced by cutting the circular tube and the tube were measured for hardness, indicating the same values, and thus we determined that opening of the tube has no effect on the tensile strength.

(Texture)

The average crystal grain size, the orientation distribution density in the Goss orientation and the proportion of the low-angle grain boundaries of the inclination angle 5 to 15° and the like, in the texture of the copper alloy tube produced above, were measured by the crystal orientation analysis method of the SEM equipped with an EBSP system.

In addition, Invention Examples and Comparative Examples all had a structure (texture) in which the orientation distribution densities in main orientations other than the Goss orientation, though the extents are different, were all 10% or less, and crystal faces are not present in a large number in a specific orientation, but are commonly present in each orientation at random. Here, primary orientations in which the orientation distribution density was measured are the Cube orientation, the Rotated-Goss orientation, the Brass orientation (B orientation), the Copper orientation (Cu orientation), the S orientation, the B/G orientation, the B/S orientation and the P orientation.

(Fracture Strength)

A copper alloy tube with a length of 300 mm was collected for testing from the copper alloy tube produced above and one end of the copper alloy tube was pressure-resistantly occluded with a metal jig (bolt). Then, the hydraulic pressure loaded in the tube was gradually increased by a pump from the other open side end (rate of rise: about 1.5 MPa/sec). The hydraulic pressure (MPa) when the tube exploded completely was read with a Bourdon type gage, and taken as the fracture strength of the heat exchanger tube (compression strength, pressure-resistant performance and breaking pressure). This test was carried out on the same copper alloy tube five times (for five test tubes), and the average value of the hydraulic pressures (MPa) was taken as the fracture strength.

As shown in Tables 1 and 2, Invention Examples 1 to 14 have a copper alloy tube component composition within the scope of the present invention in which the time from the heating furnace take-out to the extrusion completion is within 5.0 min and the final annealing cooling rate is 1.0° C. or higher, which are produced within the preferred production condition ranges. As a result, Invention Examples have a texture including an average crystal grain size of 30 μm or less of the copper alloy tube, a tensile strength σL of 250 MPa or more in the longitudinal direction of the tube and an orientation distribution density of 4% or less in the Goss orientation. Furthermore, the proportion of the low-angle grain boundaries of the inclination angle 5 to 15° in the texture of the copper alloy tube is also 1% or more.

As a result, Invention Examples are excellent in balance of the tensile strength σT and the elongation in the circumferential direction of the tube, and excellent in fracture strength, as compared with Comparative Examples. The fracture strength performance of these Invention Examples is shown to be tolerable to the operating pressure of the HFC-based fluorocarbons, the $CO_2$ cooling medium, and the like, described above, that is, the operating pressure of a new cooling medium which is about 1.6 to 6 times the operating pressure of the conventional cooling medium R22, even if the tube is thinned.

On the other hand, although Comparative Examples 19 and 20 have a copper alloy tube component composition within the scope of the present invention, Comparative Example 19 has a time from the heating furnace take-out to the extrusion completion of more than 5.0 minutes which is too long and Comparative Example 20 has a final annealing cooling rate of less than 1.0° C. which is too slow. As a result, these Comparative Examples have a texture including an average crystal grain size of 30 μm or less of the copper alloy tube, a tensile strength σL of 250 MPa or more in the longitudinal direction of the tube, but an orientation distribution density of more than 4%, in the Goss orientation which is too large. Consequently, these Comparative Examples are inferior in balance of the tensile strength σT and the elongation, in the circumferential direction of the copper alloy tube, and inferior in fracture strength, as compared with Invention Examples above.

In Comparative Examples 15 and 17, each content of Sn and P is too small, at less than the lower limit. Thus, although Comparative Examples above have a texture which is produced within the above described preferred production condition ranges and has an orientation distribution density of 4% or less in the Goss orientation, they are inferior in tensile strength in the longitudinal and circumferential directions of the copper alloy tube and also inferior in fracture strength.

In Comparative Examples 16 and 18, each content of Sn and P is too large, at more than the upper limit. Therefore, in Comparative Example 16, segregation was large in the ingot and the hot extrusion to the copper alloy tube was terminated. In addition, in Comparative Example 18, fractures were generated during hot exclusion and thus hot extrusion to a copper alloy tube was terminated. Hence, the structures and characteristics of the copper alloy tubes were incapable of being investigated.

In Comparative Example 21, the content of Zn is too large, at more than the upper limit. Thus, although Comparative Example has a texture which is produced within the above described preferred production condition range and has an orientation distribution density of 4% or less in the Goss orientation, it is inferior in tensile strength in the longitudinal and circumferential directions of the copper alloy tube and also inferior in fracture strength. Furthermore, because stress-corrosion cracking was caused in an accelerated corrosion test, it is not practicable.

The above results have proven the component composition of the present invention, the strength, the specification of a texture for obtaining a copper alloy tube excellent in fracture strength, tolerable to a high operating pressure for new cooling media, even if the tube is thinned, and further the signification of preferred manufacturing conditions for obtaining this texture.

TABLE 1

| | | Chemical Composition of Copper Alloy Tube (% by mass, remainder Cu) | | | |
|---|---|---|---|---|---|
| Example | Number | Sn | P | Zn | One or two or more kinds of Fe, Ni, Mn, Mg, Cr, Ti and Ag |
| Invention Example | 1 | 0.65 | 0.027 | — | — |
| | 2 | 0.12 | 0.025 | — | — |
| | 3 | 2.8 | 0.025 | — | — |
| | 4 | 1.5 | 0.008 | — | — |
| | 5 | 0.3 | 0.093 | — | — |
| | 6 | 0.6 | 0.043 | 0.12 | — |
| | 7 | 0.8 | 0.067 | 1 | — |
| | 8 | 1 | 0.01 | — | Fe: 0.02 |
| | 9 | 1.5 | 0.07 | 0.12 | Cr: 0.02 |
| | 10 | 0.8 | 0.07 | — | Ni: 0.01, Mn: 0.03 |
| | 11 | 0.4 | 0.025 | — | Mg: 0.02, Fe: 0.02 |
| | 12 | 0.5 | 0.025 | — | Ti: 0.01, Ag: 0.01 |
| | 13 | 0.5 | 0.025 | — | Fe, Cr, Mn: each 0.02 |
| | 14 | 0.3 | 0.025 | — | Ni, Mg, Ti, Ag: each 0.01 |
| Comparative Example | 15 | 0.07 | 0.025 | — | — |
| | 16 | 3.2 | 0.025 | — | — |
| | 17 | 0.5 | 0.003 | — | — |
| | 18 | 0.5 | 0.12 | — | — |
| | 19 | 0.65 | 0.027 | — | — |
| | 20 | 0.65 | 0.027 | — | — |
| | 21 | 0.4 | 0.067 | 2 | — |

TABLE 2

| | | | | | Copper alloy tube texture | | | Copper alloy tube characteristics: Tensile strength characteristics | | | |
|---|---|---|---|---|---|---|---|---|---|---|---|
| Example | Number | Alloy no. Table 1 | Time required from heating furnace take-out to extrusion completion (min) | Final annealing cooling rate (° C./min) | Goss orientation distribution rate (° C./min) | Low-angle grain boundary (%) | Average crystal grain size (μm) | Longitudinal tensile strength σL (MPa) | Circumferential tensile strength σT (MPa) | Circumferential elongation δ (%) | Fracture strength (MPa) |
| Invention Example | 1 | 1 | 3.5 | 10 | 1.8 | 3 | 25 | 288 | 281 | 52 | 45 |
| | 2 | 2 | 4.5 | 10 | 3.8 | 3 | 26 | 260 | 250 | 51 | 42 |
| | 3 | 3 | 3.5 | 25 | 1.4 | 5 | 20 | 352 | 349 | 53 | 51 |
| | 4 | 4 | 1.7 | 5 | 0.9 | 2 | 28 | 330 | 328 | 55 | 48 |
| | 5 | 5 | 3.5 | 2 | 2.5 | 1 | 26 | 275 | 274 | 52 | 44 |
| | 6 | 6 | 3.5 | 15 | 1.6 | 1 | 21 | 277 | 275 | 53 | 43 |
| | 7 | 7 | 3.5 | 4 | 1.5 | 1 | 28 | 281 | 277 | 53 | 44 |
| | 8 | 8 | 4.0 | 5 | 2 | 2 | 26 | 290 | 288 | 51 | 45 |
| | 9 | 9 | 4.0 | 12 | 2.1 | 2 | 27 | 281 | 278 | 51 | 44 |
| | 10 | 10 | 4.0 | 12 | 1.9 | 2 | 26 | 292 | 286 | 51 | 45 |
| | 11 | 11 | 4.0 | 12 | 1.9 | 2 | 26 | 294 | 288 | 51 | 45 |
| | 12 | 12 | 4.0 | 12 | 2 | 2 | 25 | 280 | 274 | 50 | 44 |
| | 13 | 13 | 4.0 | 12 | 1.8 | 2 | 24 | 285 | 279 | 52 | 44 |
| | 14 | 14 | 4.0 | 12 | 1.9 | 2 | 24 | 281 | 275 | 51 | 44 |
| Comparative Example | 15 | 15 | 3.5 | 10 | 2.3 | 3 | 25 | 245 | 243 | 51 | 37 |
| | 16 | 16 | — | — | — | — | — | — | — | — | — |
| | 17 | 17 | 3.5 | 5 | 3.0 | 2 | 33 | 248 | 246 | 49 | 39 |
| | 18 | 18 | — | — | — | — | — | — | — | — | — |
| | 19 | 19 | 6.0 | 20 | 4.5 | 4 | 24 | 285 | 280 | 45 | 40 |
| | 20 | 20 | 3.5 | 0.7 | 4.1 | 0.5 | 28 | 282 | 276 | 44 | 39 |
| | 21 | 21 | 3.5 | 5 | 3.0 | 1 | 29 | 255 | 248 | 50 | 39 |

INDUSTRIAL APPLICABILITY

The copper alloy tube of the present invention is excellent in fracture strength and tolerable to a high operating pressure of a new cooling medium even if the tube is thinned at 1.0 mm or less. Therefore, the copper alloy tube can be used for a heat exchanger tube of a heat exchanger which uses new cooling media such as carbon dioxide and HFC-based fluorocarbons (smooth tube and inner helically grooved tube), cooling medium piping or in-flight piping which connects the evaporator and the condenser of the above heat exchanger. In addition, because the copper alloy tube of the present invention has an excellent pressure fracture strength after heated by brazing, the tube can be used for heat exchanger tubes which have a brazing part, water pipes, kerosene pipes, heat pipes, four-way valves, control copper tubes, and the like.

What is claimed is:

1. A copper alloy tube for a heat exchanger having a fracture strength of at least 42 MPa, wherein the copper alloy tube comprises Sn:0.1 to 3.0% by mass and P:0.005 to 0.1% by mass, the remainder has a composition made from Cu and inevitable impurities, the average crystal grain size is 30 μm or less, and the longitudinal tensile strength of the tube is 250 MPa or more, and wherein the copper alloy tube comprises:

a texture whose orientation distribution density in the Goss orientation is 4% or less, and wherein the proportion of the low-angle grain boundaries of the inclination angle 5 to 15° in the texture of the copper alloy tube is 1% or more.

2. The copper alloy tube for a heat exchanger excellent in fracture strength according to claim 1, further comprising:

Zn: 0.01 to 1.0% by mass.

3. The copper alloy tube for a heat exchanger excellent in fracture strength according to claim 1, further comprising:

less than 0.07% of the total amount of one or two or more kinds of elements selected from the group consisting of Fe, Ni, Mn, Mg, Cr, Ti and Ag.

* * * * *